US006142326A

United States Patent [19]

Cornell et al.

[11] Patent Number: 6,142,326

[45] **Date of Patent: *Nov. 7, 2000**

[54] STRAW IN A BOTTLE

[75] Inventors: Stephen W. Cornell, Naperville, Ill.; Peter F. Murphy, Grosse Pointe, Mich.

[73] Assignee: The PopStraw Company, Roseville, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/016,847

[22] Filed: Jan. 30, 1998

[51] Int. Cl.[7] ..... B65D 83/00

[52] U.S. Cl. ..... 215/388; 215/40; 220/706

[58] Field of Search ..... 215/388, 40; 239/33; 229/103.1; 220/705, 706; 426/85

[56] References Cited

U.S. PATENT DOCUMENTS

| | | | |
|---|---|---|---|
| 942,306 | 12/1909 | Clarke . | |
| 1,253,579 | 1/1918 | Deanes . | |
| 1,309,994 | 7/1919 | McAuliffe . | |
| 1,997,914 | 4/1935 | Pollard . | |
| 2,150,439 | 3/1939 | Hamilton . | |
| 2,260,968 | 10/1941 | Cordis . | |
| 2,279,396 | 4/1942 | Hanson, Jr. . | |
| 2,613,988 | 10/1952 | Jarbeau . | |
| 2,837,234 | 6/1958 | Mainere . | |
| 2,997,195 | 8/1961 | Yuen . | |
| 3,013,686 | 12/1961 | Blunt | 215/42 |
| 3,099,565 | 7/1963 | Neuhauser . | |
| 3,101,855 | 8/1963 | Yuen . | |
| 3,211,379 | 10/1965 | Burton . | |
| 3,220,587 | 11/1965 | Griffin et al. . | |
| 3,291,331 | 12/1966 | Grisham et al. . | |
| 3,326,695 | 6/1967 | Neuhauser . | |
| 3,568,870 | 3/1971 | Elston . | |
| 3,746,197 | 7/1973 | Sather . | |
| 3,756,397 | 9/1973 | Ganz | 206/145 X |
| 3,776,458 | 12/1973 | Chunga, Sr. . | |
| 4,194,674 | 3/1980 | Pearson | 215/229 X |
| 4,379,511 | 4/1983 | del Fabro . | |
| 4,448,316 | 5/1984 | Hiroshige | 215/229 X |
| 4,733,785 | 3/1988 | Turner, Jr. et al. . | |
| 4,744,477 | 5/1988 | Wofford . | |
| 4,877,148 | 10/1989 | Larson et al. . | |
| 4,892,187 | 1/1990 | Stein | 220/705 |
| 5,160,058 | 11/1992 | Ahn . | |
| 5,431,297 | 7/1995 | Rosello . | |
| 5,582,289 | 12/1996 | Wright | 206/139 |

*Primary Examiner*—Stephen P. Garbe
*Assistant Examiner*—Tri M. Mai
*Attorney, Agent, or Firm*—Harness, Dickey & Pierce, P.L.C.

[57] ABSTRACT

A container includes a body defining a chamber having a neck region and a straw disposed within the chamber. The straw is inserted through the neck region and into the chamber prior to filling the chamber and is trapped or wedged between the bottom of the container and an annular ridge defined by the neck region of the chamber. When filling has been completed, the body is manipulated to release the straw from the annular ridge and position it within the neck region.

23 Claims, 4 Drawing Sheets

STRAW IN A BOTTLE

FIELD OF THE INVENTION

The present invention relates to container for beverages. More particularly, the present invention relates to beverage containers having a self-contained straw which automatically extends through the opening when the container is opened.

BACKGROUND OF THE INVENTION

Various designs gave been proposed in the prior art for placing a straw within a beverage container that becomes accessible to the user when the beverage container is opened. Some of the prior art designs rely upon the user to manipulate the container after it has been opened to align the straw with the opening. Once aligned, the buoyancy of the straw and/or a float extend the straw through the opening. Still other prior art designs include a mechanism which locates the straw within the container. The act of opening the container imparts a force and/or motion to the mechanism which then positions the straw in line with the opening. Again, buoyant forces acting on the straw extend the straw through the opening once it has been aligned.

While the prior art straw dispensing mechanisms remain technologically and commercially viable, the continued development of these systems has been directed to lowering the complexity and costs associated with these mechanisms while simultaneously maintaining and/or improving upon the reliability of these mechanisms.

SUMMARY OF THE INVENTION

The present invention provides the art with a unique dispensing mechanism which simplifies the way in which the straw is retained during the filling process while simultaneously ensuring that the straw will be available to the user upon opening the container.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
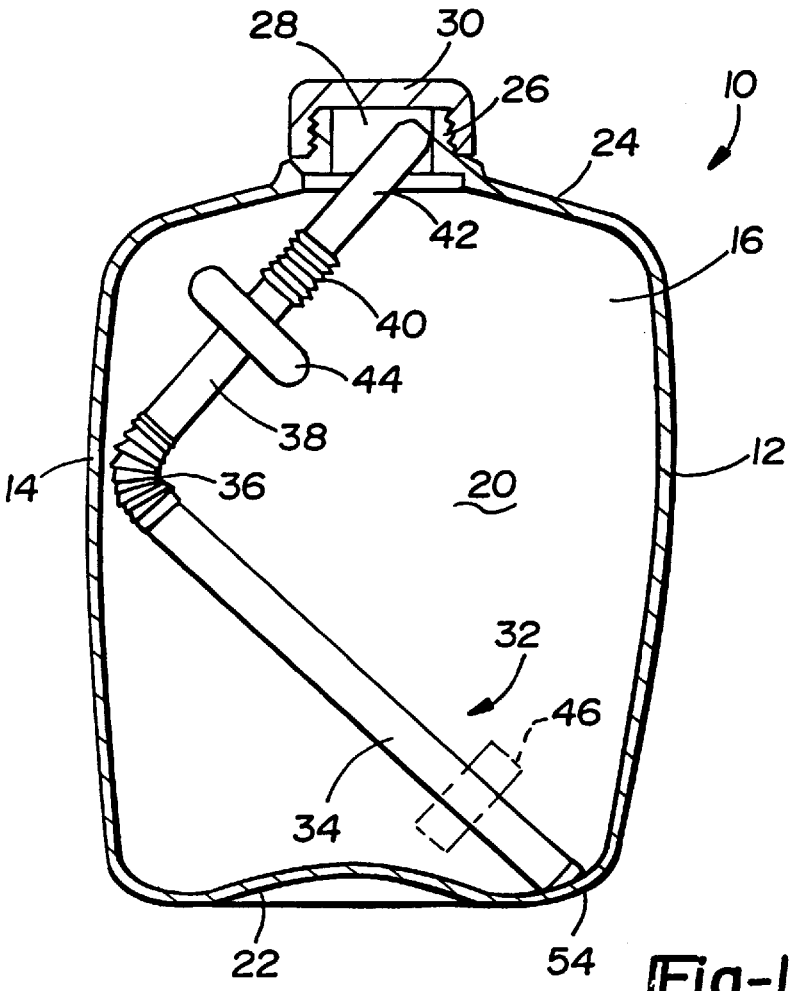
FIG. 1 is a cross sectional side view of a closed plastic bottle incorporating the straw and straw dispensing device in accordance with the present invention.

Referring now to the drawings in which like reference numerals designate like or corresponding parts throughout the several views, there is shown in FIG. 1 a beverage container incorporating an internal straw in accordance with the present invention which is designated generally by the reference numeral 10. Beverage container 10 is a generally rectangular parallelepiped container having a first pair of generally parallel side walls 12 and 14 and a second pair of generally parallel side walls 16 and 18. While container 10 is shown as a generally rectangular parallelepiped container, it is to be understood that container 10 could be manufactured in additional shapes including but not limited to cylindrical containers, square containers or the like. Walls 12, 14, 16 and 18 form a generally rectangular structure having an internal chamber 20 which is closed by a bottom wall 22 and a top wall 24. Container 10 may be manufactured by any of the conventional manufacturing techniques including but not limited to extrusion blow molding, reheat stretch blow molding or injection stretch blow molding. When being manufactured by extrusion blow molding, the preferable materials include polyolefins such as high density polyethylene (HDPE), polyethylene terephthalate (PET) or polyvinyl chloride (PVC). When either the reheat stretch blow molding or the injection stretch blow molding are being used to manufacture container 10, the preferred materials include PET or polypropylene (PP).

Top wall 24 includes a cylindrical extension 26 which defines a neck region 28 through which fluid is stored in beverage container 10 can be dispensed. Neck region 28 is shown being closed and sealed by a threaded cap 30 but it is to be understood that neck region 28 can be closed and sealed by other means known in the art including but not limited to a snap cap closure or an induction bonded foil seal closure. Top wall 24 is shown being slightly angled towards neck region 28 to provide a cone of entry into neck region 28 from chamber 20.

A straw 32 is disposed within chamber 20 and, as shown in FIG. 1, is disposed adjacent to threaded cap 30. Straw 32 comprises a lower tubular section 34, a lower pleated section 36, a middle tubular section 38, an upper pleated section 40, an upper tubular section 42 and a float 44. Lower pleated section 36 provides the ability for straw 32 to bend and be preloaded within chamber 20. Upper pleated section 40 provides the ability for straw 32 to be extended for the convenience of the user. Float 44 is attached to middle tubular section 38 and provides buoyancy for straw 32 to urge it against threaded cap 30 after chamber 20 of container 10 has been filled with a fluid. If additional buoyancy is needed for straw 32, a second float 46 can be attached to straw 32 as shown in phantom in FIG. 1 where float 46 is attached to lower tubular section 34 of straw 32.

Figure 2:
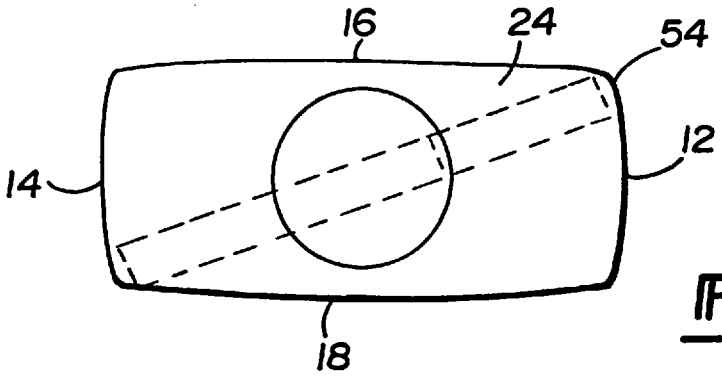
FIG. 2 is a top elevational view of the plastic bottle shown in FIG. 1.
Figure 3:
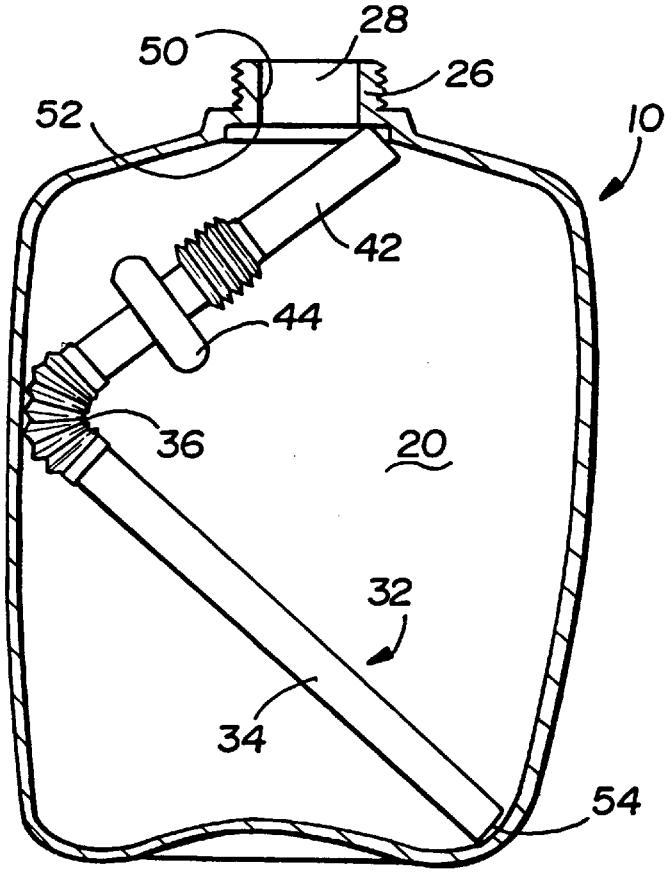
FIG. 3 is a cross sectional side view similar to FIG. 1 but showing the container and the straw dispensing device prior to the filling of the plastic bottle.

Referring now to FIG. 3, container 10 is shown prior to being filled with the fluid with straw 32 being located and retained within chamber 20. Neck region 28 is a stepped opening which defines a generally cylindrical wall 50 and an annular step 52. Prior to filling, straw 32, in a straight condition, is inserted into chamber 20 through neck region 28 until the end of lower tubular section 34 contacts a lower corner 54 of container 10. In order to secure straw 32 within chamber 20, lower corner 54 is preferably defined by one of the first parallel side walls 12 and 14, one of the second parallel side walls 16 and 18, and bottom wall 22 as shown in FIG. 2. When the end of lower tubular section 34 contacts corner 54, straw 32 flexes or bends at lower pleated section 36 and the upper end of upper tubular section 42 is snapped or wedged into annular step 52 to retain straw 32 within chamber 20 as shown in FIG. 3. Straw 32 is held against annular step 52 due to the elasticity of lower pleated section 36 which maintains the tendency to spring back towards a position where straw 32 is once again straight.

Once container 10 has been filled with the appropriate fluid and threaded cap 30 or another cap, is secured to extension 26 to seal neck region 28, walls 12, 14, 16 and/or 18 are squeezed or manipulated by suitable means in order to release the upper end of upper tubular section 42 from annular step 52 into the cone of entry and direct it into neck region 28. In the alternative, container 10 can be tilted or otherwise manipulated with or without the squeezing of one or more walls 12, 14, 16 and/or 18 to release the upper end of upper tubular section 42 from annular step 52. Once the upper end of upper tubular section 42 enters neck region 28 defined by cylindrical wall 50, the buoyance of float 44 urges straw 32 against threaded cap 30 as shown in FIG. 1.

Figure 4:
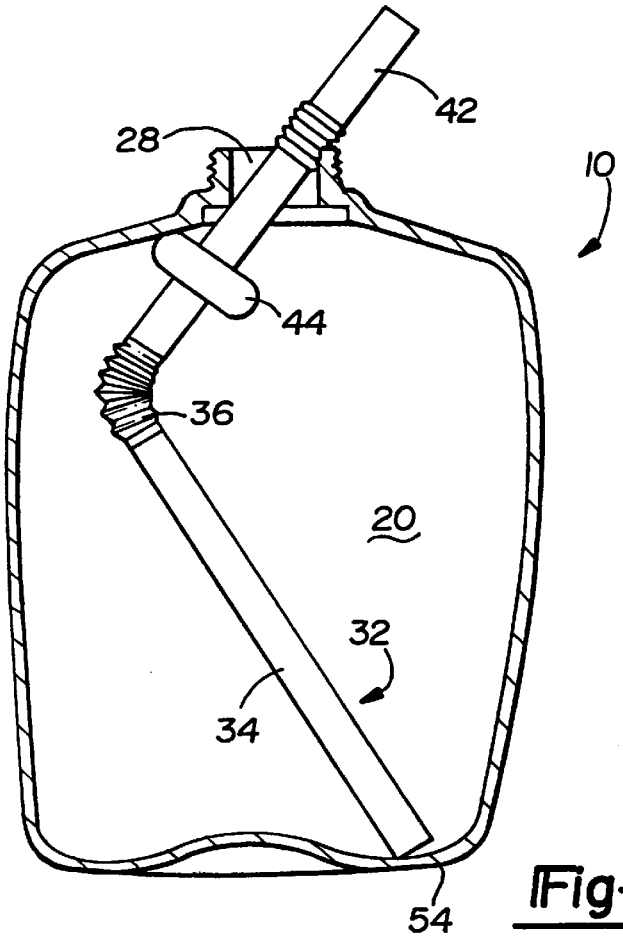
FIG. 4 is a cross sectional side view similar to FIG. 1 but showing the container and the straw dispensing device after the opening of the plastic bottle.

Referring now to FIG. 4, when threaded cap 30 is removed, straw 32 will rise through neck region 28 due to either the spring action of lower pleated section 36 which will have a tendency to straighten straw 32, the buoyancy of float 44 or both the spring action and the buoyancy. This movement of straw 32 through neck region 28 conveniently and automatically positions straw 32 for the convenience of the user. As shown in FIG. 3, the preflexed condition of straw 32 means that float 44 will propel straw 32 upwards such that upper tubular section 42 will traverse the cone of entry and neck region 28 obliquely and will not rise with the axis of the straw parallel with the axis of the bottle. Thus, straw 32 will remain generally in the position shown in FIG. 4 and will not have the tendency to bob up and down within neck region 28.

Figure 5:
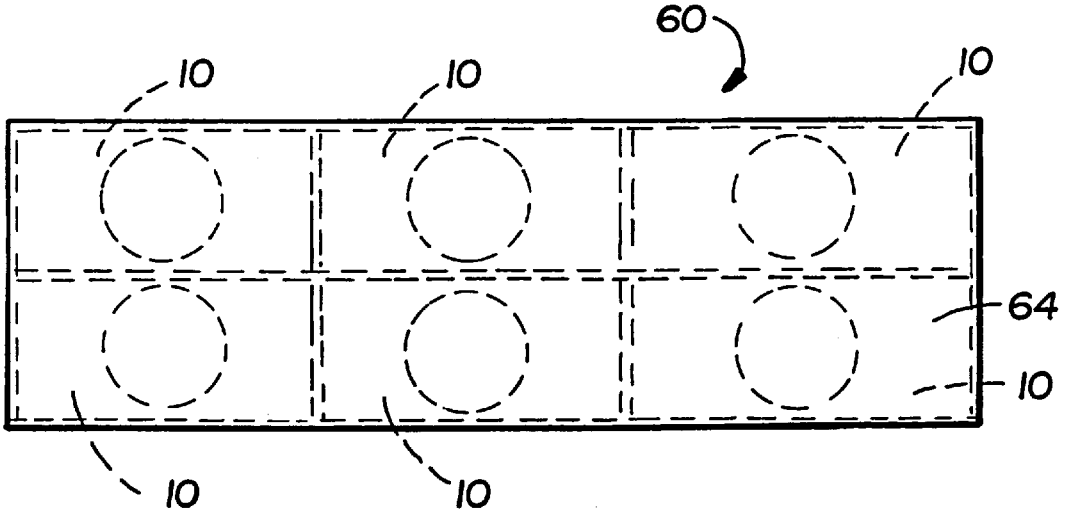
FIG. 5 is a top plan view of the multi-pack shown in FIG. 5.
Figure 6:
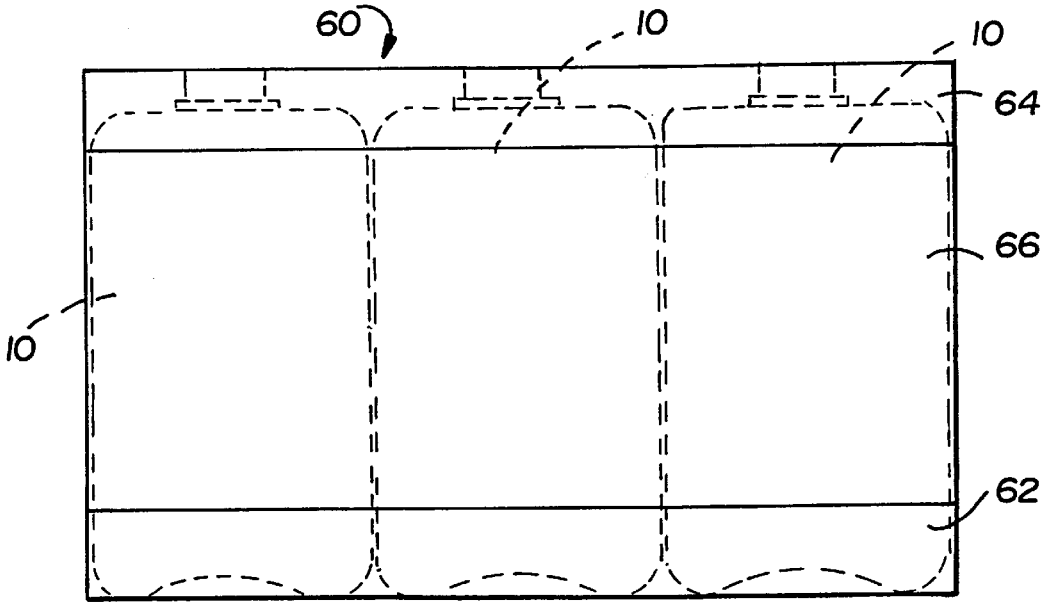
FIG. 6 is a side elevational view of a multi-pack of the beverage containers shown in FIG. 1.

FIGS. 5 and 6 illustrate the convenience provided by the generally rectangular parallelepiped shape of container 10 in supplying a multi-container pack 60 which comprises a lower carton tray bottom 62, an upper carton tray top 64 and a shrink wrap 66 or other retaining package for pack 60. Shrink wrap 66 also provides a convenient location for colorful labeling and/or advertising.

Figure 7:
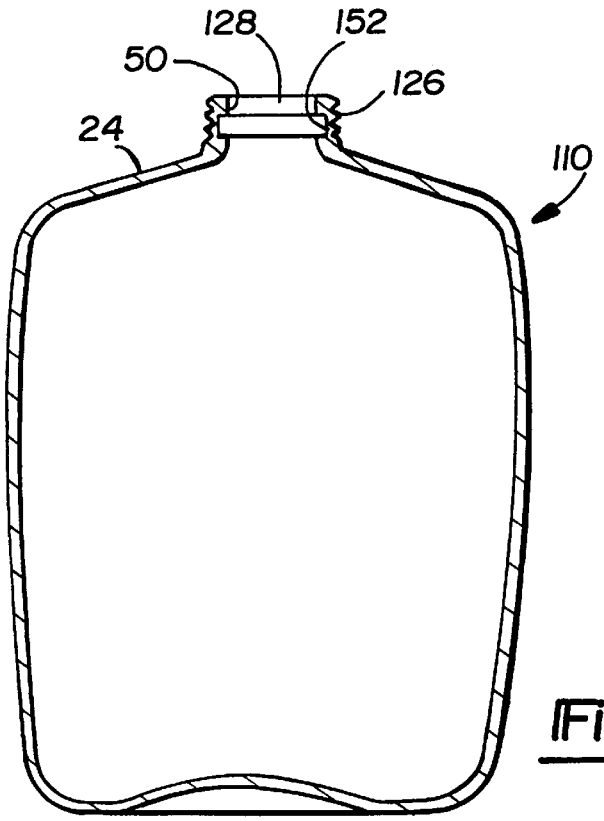
FIG. 7 is a side view of a plastic bottle in accordance with another embodiment of the present invention.

FIG. 7 illustrates a beverage container incorporating an internal straw in accordance with another embodiment of the present invention which is designated generally by the reference numeral 110. Beverage container 110 is the same as beverage container 10 with the exception that top wall 24 includes a cylindrical extension 126 which defines a neck region 128 through which fluid stored in beverage container can be dispensed. Neck region 128 is the same as neck region 28 except that generally cylindrical wall 50 defines an annular step 152 which is centrally located within wall 50 rather than being located adjacent the lower end of wall 50. The function and operation of container 110 is the same as that for container 10.

Figure 8:
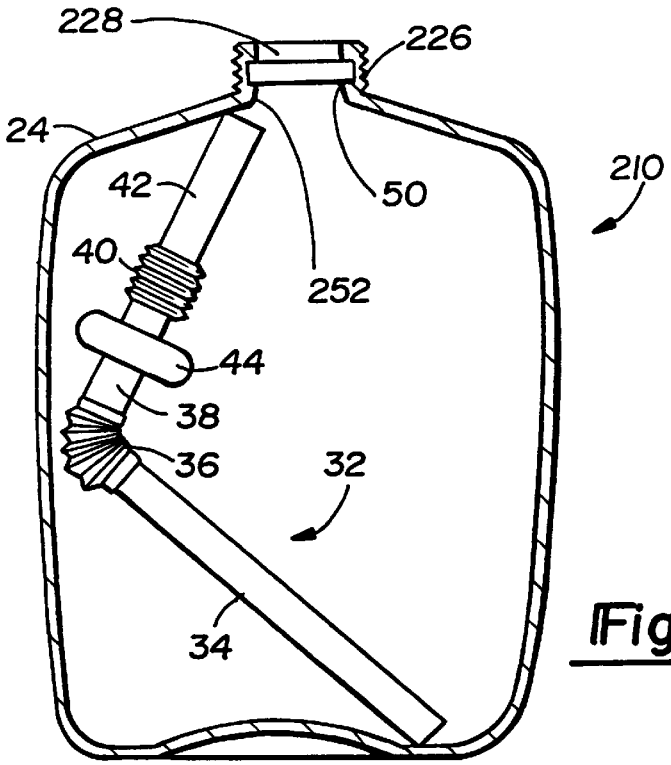
FIG. 8 is a side view of a plastic bottle in accordance with another embodiment of the present invention.

FIG. 8 illustrates a beverage container incorporating an internal straw in accordance with another embodiment of the present invention which is designated generally by the reference numeral 210. Beverage container 210 is the same as beverage container 10 with the exception that top wall 24 includes a cylindrical extension 226 which defines a neck region 228 through which fluid stored in beverage container can be dispensed. Neck region 228 is the same as neck region 28 except that generally cylindrical wall 50 defines an annular ridge 252 which is located at the lower end of wall. The function and operation of container 210 is the same as that for container 10. This embodiment provides the advantage that straw 32 will be located away from neck region 228 prior to container 210 being filled with a fluid. This position of straw 32 allows total access to neck region 228 without having to avoid straw 32 with the filling mechanism.

While the above detailed description describes the preferred embodiment of the present invention, it should be understood that the present invention is susceptible to modification, variation and alteration without deviating from the scope and fair meaning of the subjoined claims.

What is claimed is:

1. A container comprising:

a body defining a chamber and having a neck region defining an opening for communicating with said chamber, said neck region defining a cylindrical wall and an annular step, said top end of said straw being trapped in said annular step when said straw is in said first position;

a cap sealingly closing said opening; and a straw having a top end and a bottom end disposed through said opening into said chamber and movable between a first position where said straw is retained within said chamber by mechanical engagement between said top end of said straw and said body and a second position where said straw is unrestrained within said chamber and a portion of said straw is disposed within said neck region.

2. The container according to claim 1, wherein, said annular step is located at one end of said cylindrical wall.

3. The container according to claim 1 wherein, said annular step is centrally located in said cylindrical wall.

4. The container according to claim 1 wherein, said bottom end of said straw is disposed within a corner defined by said body.

5. The container according to claim 4 wherein, said straw includes a pleated section, said straw being bent at said pleated section when said straw is in said first position.

6. The container according to claim 4 wherein, said body defines a first wall, a second wall and a cover, said corner being defined by said first wall, said second wall and said cover.

7. A container comprising:

a body defining a chamber and having a neck region defining an opening for communicating with said chamber, said neck region defining a cylindrical wall and ridge, said top end of said straw being trapped by said ridge when said straw is in said first position;

a cap sealingly closing said opening; and a straw having a top end and a bottom end disposed through said opening into said chamber and movable between a first position where said straw is retained within said chamber by mechanical engagement between said top end of said straw and said body and a second position where said straw is unrestrained within said chamber and a portion of said straw is disposed within said neck region.

8. The container according to claim 7 wherein, said bottom end of said straw is disposed within a corner defined by said body.

9. The container according to claim 8 wherein, said straw includes a pleated section, said straw being bent at said pleated section when said straw is in said first position.

10. The container according to claim 8 wherein, said body defines a first wall, a second wall and a cover, said corner being defined by said first wall, said second wall and said cover.

11. The container according to claim 7 further comprising a float attached to said straw.

12. A pack comprising a plurality of containers, each of said containers comprising:

a body defining a chamber and having a neck region defining an opening for communicating with said chamber, said neck region defining a cylindrical wall and an annular step, said top end of said straw being trapped in said annular step when said straw is in said first position;

a cap sealingly closing said opening; and a straw having a top end and a bottom end disposed through said opening into said chamber and movable between a first position where said straw is retained within said chamber by mechanical engagement between said top end of said straw and said body and a second position where said straw is unrestrained within said chamber and a portion of said straw is partially disposed within said region.

13. The pack according to claim 12 wherein, said bottom end of said straw is disposed within a corner defined by said body.

14. The pack according to claim 13 wherein, said straw includes a pleated section, said straw being bent at said pleated section when said straw is in said first position.

15. The pack according to claim 13 wherein, said body defines a first wall, a second wall and a cover, said corner being defined by said first wall, said second wall and said cover.

16. The pack according to claim 12, wherein, said annular step is located at one end of said cylindrical wall.

17. The pack according to claim 12 wherein, said annular step is centrally located in said cylindrical wall.

18. A pack comprising a plurality of containers, each of said containers comprising:

a body defining a chamber and having a neck region defining an opening for communicating with said chamber, said neck region defining a cylindrical wall and ridge, said top end of said straw being trapped by said ridge when said straw is in said first position;

a cap sealingly closing said opening; and a straw having a top end and a bottom end disposed through said opening into said chamber and movable between a first position where said straw is retained within said chamber by mechanical engagement between said top end of said straw and said body and a second position where said straw is unrestrained within said chamber and a portion of said straw is partially disposed within said neck region.

19. The container according to claim 18 wherein, said bottom end of said straw is disposed within a corner defined by said body.

20. The container according to claim 19 wherein, said straw includes a pleated section, said straw being bent at said pleated section when said straw is in said first position.

21. The container according to claim 19 wherein, said body defines a first wall, a second wall and a cover, said corner being defined by said first wall, said second wall and said cover.

22. The container according to claim 18 further comprising a float attached to said straw.

23. A method of manufacturing a closed container having a straw with a top end and bottom end located within a chamber defined by said container, said method comprising the steps of:

inserting said straw into said chamber through an opening defined by a neck region in the container;

wedging said straw between a bottom of said container and an annular ridge defined by said neck region;

sealing the opening in said neck region; and manipulating said container to unrestrain said straw within said chamber and position a portion of said straw into said neck region.

* * * * *

UNITED STATES PATENT AND TRADEMARK OFFICE

CERTIFICATE OF CORRECTION

PATENT NO. : 6,142,326
DATED : November 7, 2000
INVENTOR(S) : Stephen W. Cornell et al.

It is certified that error appears in the above-identified patent and that said Letters Patent is hereby corrected as shown below:

Column 5, claim 12,
Line 12, after "said", insert -- neck --.

Signed and Sealed this

Sixth Day of November, 2001

*Attest:*

Nicholas P. Godici

NICHOLAS P. GODICI
*Acting Director of the United States Patent and Trademark Office*

*Attesting Officer*